United States Patent [19]

Cowley

[11] Patent Number: 4,926,815

[45] Date of Patent: May 22, 1990

[54] RAPID SHUT-OFF SYSTEM FOR TRUCK ENGINE

[75] Inventor: Trent E. Cowley, Wright, Wyo.

[73] Assignee: Atlantic Richfield Company, Los Angeles, Calif.

[21] Appl. No.: 403,633

[22] Filed: Sep. 6, 1989

[51] Int. Cl.[5] ..... F02B 77/08

[52] U.S. Cl. ..... 123/198 DB; 123/198 D

[58] Field of Search ..... 123/198 DB, 198 D

[56] References Cited

U.S. PATENT DOCUMENTS 4,331,114 5/1982 Karraker ..... 123/198 DB 4,338,896 7/1982 Papasideris ..... 123/198 D

*Primary Examiner*—Noah P. Kamen

*Attorney, Agent, or Firm*—Michael E. Martin

[57] ABSTRACT

An engine fuel fow shut-off system particularly adapted for off-highway dumper trucks includes a spring biased fuel shut-off valve interposed in the fuel supply conduit to the truck propulsion engine, which valve is held open by a manual valve actuator and a pneumatic cylinder and piston actuator engaged with the valve actuator. Compressed gas charge bottles operable from the operator's cab and from a ground position in proximity to the vehicle boarding ladder supply pressure fluid to the cylinder actuator to disengage a pin from the valve actuator stem to permit closure of the valve and closure of a second valve to interrupt engine lube oil pressure to an engine injector system governor. The vehicle on-board fire extinguishing system is also operably connected to the cylinder actuator by way of separate pressure fluid sources to effect closure of the fuel shut-off valve upon actuation of the first extinguishing system from either the operator's cab or the ground position.

9 Claims, 1 Drawing Sheet

RAPID SHUT-OFF SYSTEM FOR TRUCK ENGINE

BACKGROUND OF THE INVENTION

1. Field of the Invention

The present invention pertains to an emergency engine fuel flow shut-off system operable from the driver's station and from outside the vehicle, and particularly adapted for large off-highway trucks and similar vehicles.

2. Background

Emergency engine shut-down systems are considered desirable in many internal combustion engine applications, particularly, for example, in regard to engines operating in hazardous environments in off-highway construction and mining equipment and the like. One type of engine shut-down system used on diesel engine powered off-highway haulage trucks, of a type sometimes known as dumpers, comprises a cable operated butterfly or flapper type valve which may be operated by the vehicle driver to shut off air flow to the engine. Off-highway haulage trucks, such as used in large open pit mines and similar applications, operate in an environment which is not favorable to cable-operated devices since the cable mechanism often becomes contaminated with fine dirt and dust which hinders suitable functional actuation of the cable and the engine shut-down valve. Moreover, on diesel engines in particular, if the combustion air flow to the engine is maintained at even a reduced capacity, the engine will continue to run without shut-off of fuel flow.

Still further, the operating environment of the aforementioned types of trucks, particularly in large open-pit coal mines provides a somewhat more hazardous operating environment and a stronger likelihood that an engine fire may occur from time to time on board such trucks. In this regard it is desirable to have an emergency engine shut-down system which is operable not only from the driver's station or cab but also from the ground adjacent to the driver boarding ladder in the event that the driver must exit the vehicle before having the opportunity to actuate the engine shut-off system. The foregoing considerations have resulted in an improved emergency engine shut-down system particularly adapted for off-highway dumper trucks and the like as described hereinbelow.

SUMMARY OF THE INVENTION

The present invention provides an improved engine shut-off system for use on off-highway haulage or dumper type trucks and similar applications. In accordance with one important aspect of the present invention, an improved engine shut-off system is provided which includes a shut-off valve interposed in the fuel supply conduit between the fuel tank and the engine fuel injection system and preferably adapted to be spring actuated to its closed position and manually actuated to an open position. The valve is held in its open position by a fluid actuator cooperating with a manual valve actuating mechanism.

In accordance with another aspect of the present invention, there is provided a fluid actuated engine shut-down system for a truck engine and the like which may be operated from the driver's cab or from a ground location adjacent to the vehicle boarding stairway or ladder. The engine shut-down system is preferably interconnected with an on-board fire extinguishing system which is also fluid actuated. The fire extinguishing system is interconnected with the engine shut-down system whereby the engine fuel flow is interrupted upon actuation of the fire extinguishing system from either the driver's cab or the location of the ground operated point of actuation for the engine shut-down system.

Those skilled in the art will further appreciate the above-described advantages and features of the present invention together with other superior aspects thereof upon reading the detailed description which follows in conjunction with the drawing.

DESCRIPTION OF A PREFERRED EMBODIMENT

Figure 1:
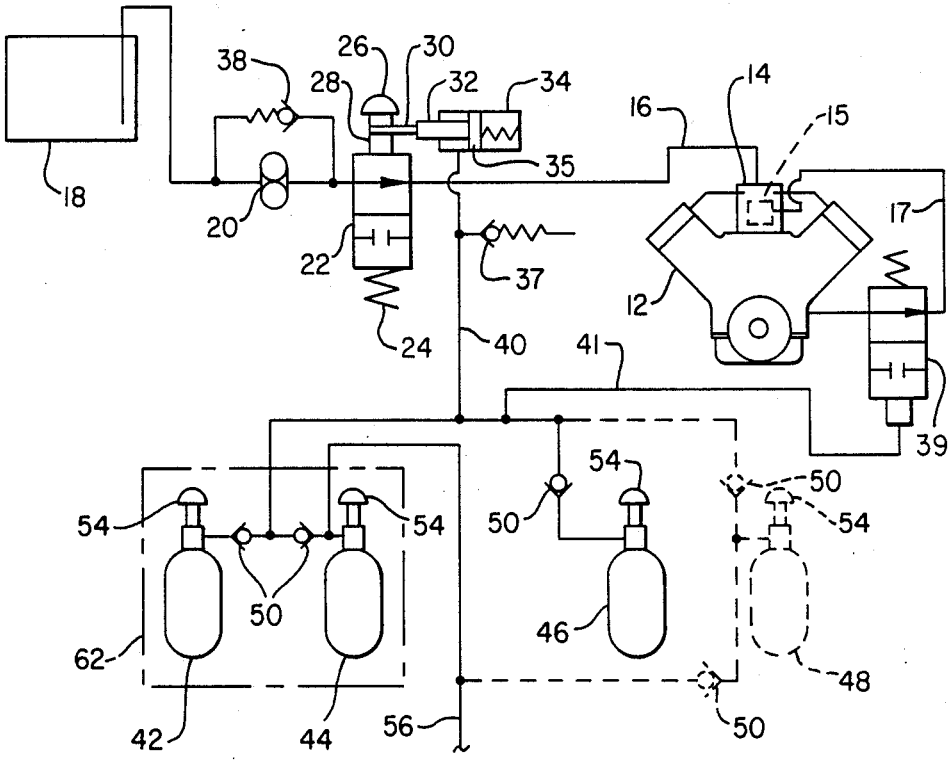
FIG. 1 is a schematic diagram of the improved engine shut-down system of the present invention.

In the description which follows, like parts are marked throughout the specification and drawing with the same reference numerals, respectively. Certain features may be illustrated in the drawing in schematic form in the interest of clarity and conciseness.

One application of high-speed diesel engines which requires a fast-acting and positive shut-down system is in the use of these engines as propulsion sources for large off-highway trucks, sometimes known as "dumpers", used in hauling coal, ore and other earth materials in open pit mining operations. In the mining of coal, for example, the chance of a fire occurring on board the haulage truck is somewhat increased due to the accumulation of coal dust on and about various portions of the vehicle. The presence of coal dust and the like also tends to contaminate mechanically actuated devices on the truck including the aforementioned conventional cable-operated engine shut-down mechanisms. Moreover, the physical size of these trucks requies the driver or operator to sit in a relatively small cab 15 to 20 feet above the ground, which cab must be vacated immediately in the interest of the driver's safety upon indication of a fire on board the truck. These types of trucks have been equipped with fire extinguishing system which are fluid actuated from sources of compressed gas stored in small reservoirs which may be operated from the driver's cab and from a point on the ground adjacent to the vehicle boarding ladder. However, as mentioned hereinabove, the provision of conventional prior art emergency engine shut-down systems has been unsatisfactory in certain applications such as applications to these large off-highway dumper trucks when operating, in particular, in open pit mines and other areas which are constantly contaminated by air-borne dust and abrasive particulates.

To overcome the deficiencies of prior art systems, an emergency engine shut-down system has been developed as indicated in FIG. 1 and generally referenced by the numeral 10. The system 10 is operable to shut off the flow of fuel to an internal combustion engine 12 such as a V-type diesel engine having an injector pump 14 mounted thereon for distributing fuel to separate injectors, not shown. The injector pump 14 is supplied with fuel through a supply conduit 16 which may also be in direct communication with individual injector units for each engine cylinder in place of the distributor-type injector pump 14. The injector pump 14 may also be of the type wherein a governor 15 is adapted to operate the pump to change its displacement for supplying a variable quantity of fuel to the respective engine cylinders in accordance with the governor setting. The governor 15 is also responsive to the engine lube oil pressure for operation and receives such oil by way of a pressure line 17.

The fuel supply conduit 16 is adapted to be in communication with a fuel tank 18 by way of a fuel supply pump 20 and a fuel shut-off valve 22. The fuel shut-off valve 22 is operable to be actuated by a spring 24 to be in the closed position and is movable to the open position against the bias of the spring 24 by a manual valve actuator 26. The valve actuator 26 preferably has a stem 28 through which a retaining pin 30 is operable to project to hold the valve 22 in the open position against the bias of the spring 24. The pin 30 is connected to the piston rod 32 of a fluid operated cylinder and piston-type actuator 34 which is operable to be actuated by pressure fluid to withdraw the pin 30 from engagement with the valve actuator stem 28. The actuator 34 is spring biased to hold the pin 30 engaged with the stem 28. Accordingly, if the actuator 34 is energized to move its piston 35 to the right, viewing FIG. 1, the pin 30 will be withdrawn from the actuator stem 28 and the valve 22 will move rapidly to the closed position shutting off the flow of fuel to the engine 12. If a fuel system is used which includes a pump such as a pump 20 upstream of the valve 22, a pressure relief valve 38 is preferably provided in circuit as illustrated in FIG. 1 to prevent rupture of the fuel supply conduit 16 or catastrophic damage to the pump 20 upoon rapid actuation of the valve 22. A normally open valve 39 is interposed in the pressure line 17 and is responsive to pressure fluid to move to a closed position to effect operation of the governor 15 to set the pump 14 at effectively zero fuel output to the engine 12.

The actuator 34 and valve 39 are operated by pressure fluid, preferably compressed gas, supplied to the actuator by way of conduits 40 and 41 which are in communication with plural sources of compressed gas including charge reservoirs or bottles 42, 44, 46 and 48. Each of the charge bottles has a compressed gas output or supply conduit operably connected to the conduit 40 as indicated in FIG. 1. Check valves 50 are interposed in each of the charge bottle supply conduits. The actuator 34 and valve 39 are energized in the event of operation of any one of the charge bottles 42, 44, 46 or 48. The compressed gas charge bottles 42, 44, 46 and 48 are of a type wherein a manual actuator 54, having a so-called palm button or lever-type mechanism which may be rapidly manually actuated, is provided for rupturing a seal in the bottle to provide for the release of compressed gas to the conduit 40. The gas reservoir or charge bottles 42, 44, 46 and 48 may be of a type manufatured by Ansul Company, Marinette, Wisconsin, under their part number 16723. As shown in FIG. 1, the charge bottles 44 and 48 are also in communication with a conduit 56 leading to an on-board fire extinguishing system, not shown, for extinguishing fires on a vehicle operated by the engine 12.

Figure 2:
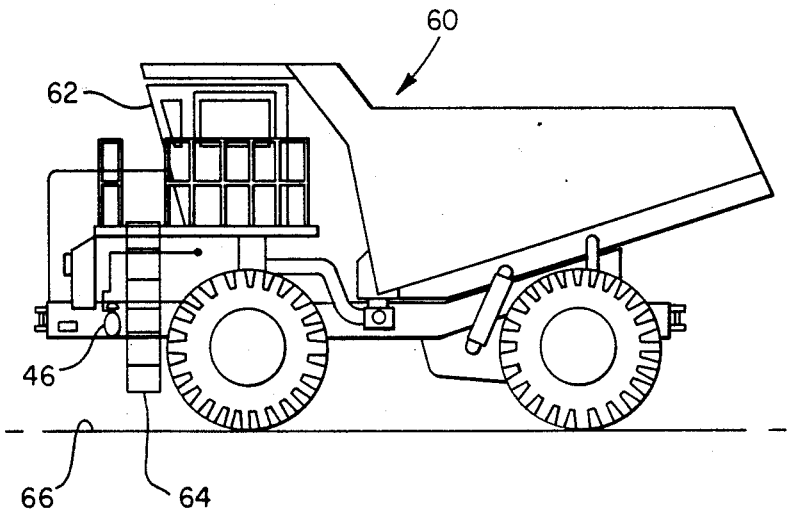
FIG. 2 is a side view of an off-highway dump truck illustrating one preferred point of operation of the engine shut-down system.

FIG. 2 is a view of a conventional large tonnage off-highway haulage truck or "dumper", generally designated by the numeral 60. The dumper 60 includes an operator's cab 62 which is accessed from the ground by a boarding ladder 64. Vehicles such as the dumper truck 60 are built in various sizes but the larger tonnage sizes, which are capable of payloads up to over 200 tons, are relatively large machines wherein the operator's cab is located several feet above the ground surface 66. An emergency on board a vehicle of this size requires consideration by the opeator of the amount of time required to exit the vehicle. Accordingly, it is considered preferably to have certain emergency controls located on the ground in proximity to the boarding ladder 64.

In accordance with the present invention, the emergency engine shut-down system may be actuated by either the charge bottle 42 or 44 from the cab 62 as indicated schematically in FIG. 1. Typically the actuator buttons 54 for the charge bottles 42 and 44 are mounted on the operator's control panel, not shown, within the cab 62 and are appropriately labelled as engine shut-down and fire extinguishing system, respectively. Actuation of either of the charge bottles 42 or 44 will effect closure of the valve 39 to effect resetting the injector pump displacement to essentially zero fuel flow to the individual engine cylinders and movement of the actuator 34 to release the valve actuator stem 28 allowing the valve 22 to close and shutting off the flow of fuel to the engine 12. However, it is also desirable to be able to shut off the engine 12 with or without actuation of the fire extinguishing system from a position on the ground adjacent to the boarding ladder 64, for example. In this regard the charge bottle 46, adapted for operating only the engine emergency shut-down system, is located generally in the vicinity of the boarding ladder 64 and operable from the ground by a vehicle operator who has just deboarded or by personnel assisting in shutting down the operation of the dumper truck 60. Preferably the second fire extinguishing system actuator or charge bottle 48 is also located adjacent to the charge bottle 46. As indicated by the schematic diagram of FIG. 1, the emergency engine shut-down ystem 10 is also operated if either of the charge bottles 44 or 48 is actuated to release a charge of compressed gas for operating the aforementioned fire extinguishing system.

The operation of the system 10 is believed to be readily understandable from the foregoing description. Positive and rapid shut-off of fuel to the engine 12 is accomplished upon actuation of any of the charge bottles 42, 44, 46 and 48. If the charge bottles 44 or 48 are actuated, not only is the supply of fuel to the engine shut off but a fire extinguishing system, not shown is energized to minimize the chance of the spread of fire on board the vehicle 60. Depending on the construction of the actuator 34, it may be desirable to include a pressure relieve valve 37 interposed in the conduit 40 to minimize the chance of damage to the actuator if the system is energized. Positive shut-off of fuel to the engine 12 is considered to be superior to reliance on a mechanical cable-actuated air flow shut-off mechanism since positive shut-off of liquid fuel will assure relatively rapid engine shut-down.

Although a preferred embodiment of the invention has been described in detail herein, those skilled in the art will recognize that various substitutions and modifications may be made to the system described without departing from the scope and spirit of the invention as recited in the appended claims.

What is claimed is:

1. An engine shut-off system particularly adapted for use in conjunction with a propulsion engine for an off-highway vehicle such as a large dumper truck and the like, said system comprising:

a supply conduit for supplying fuel to said engine and in communication with a source of fluid fuel;

fuel flow shut-off valve means interposed in said conduit, said shut-off valve means being normally biased to a closed position and being actuated to an open position by valve actuating means;

actuator means operable to be engaged with said valve actuating means and a source of pressure fluid for placing said shut-off valve means in an operating condition which will rapidly close said shut-off valve means; and a source of pressure fluid disposed for operation from at least one of an operator's cab for said vehicle and a position in proximity to the ground surface and exterior of said vehicle for operation of said actuator means to cause said shut-off valve means to shut off fuel flow to said engine.

2. The system set forth in claim 1 including:

a source of pressure fluid and actuating means for releasing pressure fluid to operate said actuator means and a fire extinguishing system on said vehicle, substantially simultaneously.

3. The system set forth in claim 1 wherein:

said actuator means includes cylinder and piston means normally biased to hold said valve actuating means in a position to open said shut-off valve means and pressure fluid operated to release said valve actuating means for permitting movement of said shut-off valve means to the valve closed position.

4. The system set forth in claim 1 wherein:

said valve actuating means includes a stem and an actuating member for manually moving said shut-off valve means to an open position, and said actuator means includes a pin engageable with said stem for holding said shut-off valve means in the valve open position.

5. The sysem set forth in claim 1 wherein:

said source of pressure fluid is located at said cab and includes at least one of a source for operating said actuator means and a source for operating said actuator means and a fire extinguishing system for said vehicle, substantially simultaneously.

6. The system set forth in claim 1 wherein:

said source of pressure fluid includes at least one of a source for operating said actuator means and operable from said position in proximity to the ground surface and a source in said position in proximity to the ground surface and which is operable to supply a charge of pressure fluid to operate a fire extinguishing system for said vehicle.

7. The system set forth in claim 1 including:

governor means for said engine;

a pressure oil supply conduit connected to said governor means; and valve means interposed in said pressure oil supply conduit and responsive to the release of pressure fluid to operate said actuator means to interrupt pressure oil supply to said governor means.

8. An engine shut-off system particularly adapted for use in conjunction with a propulsion engine for an off-highway vehicle such as a large dumper truck and the like, said system comprising:

a supply conduit for supplying fuel to said engine and in communication with a source of fluid fuel;

fuel flow shut-off valve means interposed in said conduit, said shut-off valve means being normally biased to a closed position and being actuated to an open position by valve actuating means;

actuator means operable to be engaged with said valve actuating means and a source of pressure fluid for placing said shut-off valve means in an operating condition which will rapdily close said shut-off valve means;

an operator's cab for said vehicle;

a first source of pressure fluid located at said cab and including at least one of a source for operating said actuator means and a source for operating said actuator means and a fire extinguishing system for said vehicle, substantially simultaneously; and a second source of pressure fluid and means for releasing pressure fluid from said second source and in proximity to the ground surface and exterior of said vehicle for operation of said actuator means to cause said shut-off valve means to shut off fuel flow to said engine and operate said fire extinguishing system, substantially simultaneously.

9. An engine shut-off system particularly adapted for use in conjunction with a propulsion engine for an off-highway vehicle such as a large dumper truck and the like, said systems comprising:

governor means for said engine;

a pressure oil supply conduit connected to said governor means;

normally open valve means interposed in said conduit and responsive to a pressure fluid signal to move to a closed position to effect interruption of pressure oil supply to said governor means;

a source of pressure fluid disposed for operation to supply pressure fluid to said valve means to effect interruption of said pressure oil supply to said governor means; and actuating means disposed for operation from at least one of an operator's cab for said vehicle and a position in proximity to the ground surface and the exterior of said vehicle for causing pressure fluid to move said valve means to a closed position.

* * * * *